United States Patent [19]

Malaker et al.

[11] Patent Number: 4,796,430

[45] Date of Patent: Jan. 10, 1989

[54] CAM DRIVE FOR CRYOGENIC REFRIGERATOR

[75] Inventors: Stephen F. Malaker, Mountainside, N.J.; Alfred Gorawski, Westmoreland, N.H.

[73] Assignee: Cryodynamics, Inc., Mountainside, N.J.

[21] Appl. No.: 85,536

[22] Filed: Aug. 14, 1987

[51] Int. Cl.[4] ..... F25B 9/00

[52] U.S. Cl. ..... 62/6; 74/57

[58] Field of Search ..... 62/6; 74/56, 57

[56] References Cited

U.S. PATENT DOCUMENTS

| | | | |
|---|---|---|---|
| 1,998,945 | 4/1935 | Stein | 74/56 |
| 2,307,214 | 1/1943 | Gollmer | 74/57 |
| 2,445,819 | 7/1948 | Bell | 74/57 |
| 2,451,374 | 10/1948 | Bell | 74/57 |
| 3,107,541 | 10/1963 | Parsus | 74/57 |
| 3,183,662 | 5/1965 | Korsgren, Sr. | 62/6 |
| 4,282,716 | 8/1981 | Momose et al. | 62/6 |
| 4,375,749 | 3/1983 | Ishizaki | 62/6 |
| 4,388,808 | 6/1983 | Durenec | 62/6 |

*Primary Examiner*—Ronald C. Capossela

*Attorney, Agent, or Firm*—Kevin McMahon

[57] ABSTRACT

Modified Stirling cycle refrigerators having a cam drive unit which is illustrated as being implemented either as a rotatable cylinder having a pair of circumferential camming grooves or as wobble plates having camming tracks on the periphery thereof. The cam drive unit drives the compressor and expander piston of the refrigerator through cam followers. Refrigerator embodiments having a plurality of compressor-expander piston pairs driven from a single cam drive are also disclosed.

20 Claims, 5 Drawing Sheets

CAM DRIVE FOR CRYOGENIC REFRIGERATOR

BACKGROUND

1. Field of the Invention

This invention relates generally to drive mechanisms for cryogenic refrigerators, and more particularly to drive mechanisms for driving the compressor and expander pistons of cryogenic refrigerators.

2. Description of the Related Art

Modified Stirling cycle cryogenic cooling systems of the type described in U.S. Pat. No. 3,074,244 have proven to have substantial advantages over other types of refrigeration systems. Such cryogenic cooling systems are inherently lighter, less expensive, more reliable and more efficient than other available types. They also have the additional important advantages that they operate using non-hazardous working gases, such as helium or nitrogen, and require no condenser or evaporator coils.

Such modified Stirling cycle cooling systems are generally driven by electric motors through some form of gear drive and crankshaft arrangement. While this arrangement provides good performance for most applications, it results in design difficulties in certain applications in which the refrigerator incorporates a plurality of compressor expander piston pairs and in which compactness is of critical importance.

SUMMARY OF THE INVENTION

In accordance with the invention, there is provided an improved closed cycle modified Stirling cycle cooling unit having a first piston for compressing the working fluid in a cylinder, a second piston for expanding the compressed working fluid in a second cylinder, and a cold head in thermal contact with the working fluid in the second cylinder which includes first and second camming elements mounted for rotation at a phase angle with respect to one another. First and second cam followers are mounted in contact with the first and second camming elements, respectively, and are coupled to the respective first and second pistons for reciprocally driving the pistons within their respective cylinders upon rotation of the camming elements. Motive means such as an electric motor are provided for rotating the camming elements.

In accordance with one aspect of the invention the refrigerator includes a cylindrical element mounted for rotation about said axis by said motive means and the camming elements include continuous circumferential grooves in the periphery of the cylindrical element which define generally sinusoidal paths therein. The cam followers each include bearing means disposed in a corresponding groove for reciprocally driving the corresponding piston.

In accordance with another aspect of the invention, the camming elements may each include a wobble plate mounted for rotation about an axis at a phase angle with respect to one another and the cam followers may each include bearing means engaging a camming surface on a corresponding one of said wobble plates.

In accordance with another aspect of the invention, the Stirling cycle refrigerator may comprise a plurality of sets of compressor and expander pistons. All of the compressor pistons are reciprocally driven by one of the camming elements and all of the expander pistons are reciprocally driven by the other of the camming elements. The sets of compressor and expander pistons are arranged such that they are grouped in corresponding compressor-expander piston pairs. The cam elements define generally sinusoidal paths which are arranged so that each expander piston leads the corresponding compressor piston by a phase angle of between about 85° to 103°, and preferably of about 90°.

BRIEF DESCRIPTION OF THE DRAWINGS

The foregoing and other objects and advantages of the present invention will become more apparent from the following detailed description of the preferred embodiments when read in conjunction with the accompanying drawing, wherein.

DETAILED DESCRIPTION OF THE PREFERRED EMBODIMENTS

Figure 1:
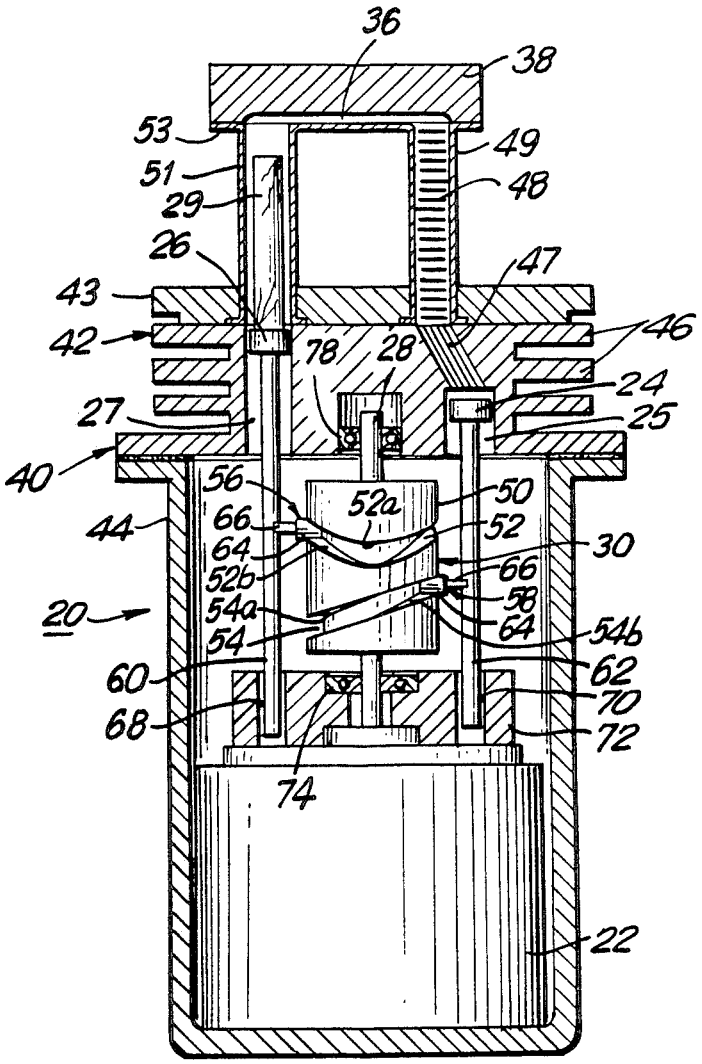
FIG. 1 is a partially cut-away isometric view of a modified Stirling cycle cryogenic cooler illustrating a first embodiment of the camming drive of the present invention.

The cryogenic refrigerator of the present invention constitutes an improvement in the closed cycle modified Stirling cycle refrigerator described in U.S. Pat. No. 3,074,244, the disclosure of which is herein incorporated by reference, and operates in same basic manner as is described in that patent. Referring now the drawings, wherein like reference numerals represent corresponding parts throughout the drawing figures, and in particular to FIG. 1, a modified Stirling cycle cryogenic cooling unit is illustrated generally by reference numeral 20. The refrigerator 20 is driven by motor 22 which is preferably an electric motor. Motor 22 drives compressor piston 24 and expander piston 26 through drive shaft 28 and cam drive assembly 30. The pistons 24 and 26 are reciprocated in cylinders 25 and 27, respectively, which are in fluid communication with one another via the heat exchanger 47, the regenerator 48 and conduit 36 formed in cold head 38 positioned adjacent the upper end of the expander cylinder 27 and the regenerator 48. A working fluid such as helium or nitrogen gas is directed between the cylinders 25 and 27 in a manner discussed in detail below to the cool cold head 38. The expander piston 26 includes an insulating member 29 extending from the upper face of the piston towards the cold head 38 to insulate the piston from the cryogenic temperatures of the working gas in the vicinity of the cold head 38. The insulating member 29 is preferably made of wood or some other relatively non-heat conductive material.

The refrigerator 20 is encased in a hermetically sealed case 40 which includes a cylinder block 42, a cylinder head 43 and a lower portion 44. The cylinder block 42 may include a plurality of cooling fins or ribs 46 to facilitate dissipation of the heat generated by the compression of the working gas in the compressor cylinder 25. The transfer of heat from the compressed working gas to the cooling fins 46 is accomplished by the heat exchanger 47 which is positioned between the compressor cylinder 25 and the regenerator 48. The heat exchanger 47 may be formed of a plurality of conductive metallic tubes disposed in a heat conductive epoxy resin for providing a large heat transfer service to the compressed working gas.

A regenerator 48 may comprise a metallic network such as metal wool of high heat capacity.

As is more completely described in the above-referenced U.S. Pat. No. 3,074,244 , the working gas is isothermally compressed in the compression cylinder 25 by the compressor piston 24 with the heat of the compression being dissipated through heat exchanger 47 and cooling fins 46. The compressed working gas is then transferred at a substantially constant volume through the regenerator 48 and the conduit 36 to the expander cylinder 27, where it is isothermally expanded by expander piston 26 at the upper portion of the cylinder 51 adjacent the cold head 38. During the expansion, heat is extracted from the cold head 38. The gas is then transferred at substantially constant volume back through the conduit 36 and the regenerator 48 to the compressor cylinder 25, where the cycle begins again.

The cold head 38 is progressively cooled on each cycle until it reaches cryogenic temperatures. Cryogenic cooling units operating in the above-described manner easily reach temperatures of 77° K at the cold head and have been operated at temperatures below 30° K.

The regenerator 48 and the upper portion of the expander cylinder 27 are encased in a thin-walled stainless steel tubes 49 and 51, respectively, which are anchored to the cylinder block 42 by the cylinder head 43. The top of the tubes 49 and 5! are integral with the flange 53 to which the cold head 38 is affixed. The channel 36 between the regenerator 48 and the expander cylinder 27 is defined by the central portion of the flange 53 between the two cylinders 49 and 51 and the recessed portion of the bottom of the cold head 38. The junctions of the thin-walled steel cylinders 49 and 51 with the cylinder block 42 and of flange 53 with the cold head 38 must be airtight so that the hermetic seal of the refrigerator 20 is maintained.

The pistons 24 and 26 are reciprocally driven by rotation of the cam drive assembly 30 which includes cylindrical element 50 that is mounted for rotation with the shaft 28. The cylinder 50 includes first and second cam grooves 52 and 54 for reciprocally driving pistons 24 and 25 through cam followers 56 and 58 and piston rods 60 and 62, respectively. The cam grooves 52 and 54 have a rectangular cross-section and provide upper **52*a*, 54*a* and lower 52*b*, 54*b* camming surfaces, respectively, along which the cam followers 56 and 58 ride. Each of the cam followers 56 and 58 is typically in the form of a roller 64 rotatably mounted on a pin 66 secured to one of piston rods 60 and 62 in a conventional manner. The diameter of the cam rollers 64 is slightly smaller than the height of the cam grooves 52 and 54 so that the rollers 64 can rotate freely in the grooves in close proximity to their respective upper and lower surfaces in order to provide efficient power transfer to the pistons 24 and 26 as cam driver 50 is rotated. Depending on whether the cam grooves are driving the corresponding piston upwardly or downwardly, the corresponding roller 64** is in contact with the lower or upper surface, respectively, of the cam groove in which it rides.

Cam grooves 52 and 54 each define a closed, single period path in the periphery of the cylinder 30 for driving the corresponding piston 26 or 24, respectively, in a substantially sinusoidal manner, one cycle for each complete rotation of the cylinder 30. The paths are oriented with respect to one another on the periphery of the cylinder 30 such that the pistons 24 and 26 reciprocate in a phase relationship to one another of from about 85° to about 103°, and preferably about 90°, with the expander piston 26 leading the compressor piston 24. The rake of each path determines the amplitude of the piston travel (piston stroke) within each cylinder.

The lower end of piston rods 60 and 62 are retained within correspondingly shaped channels 68 and 70 formed in the guide member 72. The guide member 72 is affixed to the upper surface of motor 20. Bearings 74 are provided between guide member 72 and the lower end of motor drive shaft 28.

The upper end of the shaft 28 extends upwardly from the cylinder 50 and is rotatably secured by the bearings 78 in a cavity formed in the cylinder block 42.

Figure 2:
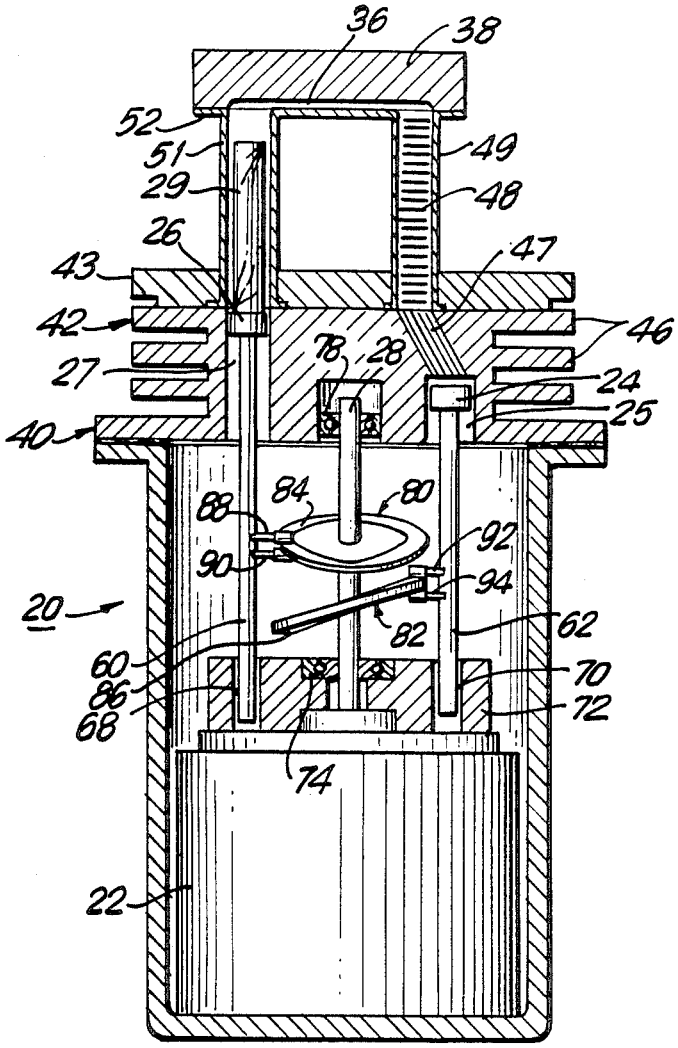
FIG. 2 is a partially cut-away isometric view of a modified Stirling cycle cryogenic cooler illustrating a second embodiment of the camming drive of the invention.

Referring now to FIG. 2 of the drawings, there is illustrated a second embodiment the modified Stirling cycle refrigerator of the invention in which the cylinder 50 is replaced by the wobble plates 80 and 82. The wobble plates 80 and 82 are mounted on the shaft 28 at a selected angle with a plane perpendicular to the shaft 28 for rotation thereby and have camming tracks 84 and 86 at their periphery. The camming tracks 84 and 86 are formed with respect to the central portion of the wobble plates such that the tracks are always radially perpendicular to the axis of the shaft 28. A pair of cam followers 88 and 90 attached to the piston rod 60 cooperate with the upper and lower surfaces of the track 84, respectively, for reciprocally driving the expander piston 26 in the cylinder 27. The cam followers 88 and 90 are each formed of a pin attached at one end to the piston rod 60 with a roller bearing at the other end which rides on the track 84. The cam followers 88 and 90 are positioned such that the space between the rollers is slightly greater than the thickness of the track 84 to permit free movement of, and efficient energy transfer from the wobble plate 80.

The cam followers 92 and 94 are mounted on the shaft 62 and are driven by the track 86 to reciprocate the compressor piston 24 in the cylinder 25. The cam followers 92 and 94 are constructed and positioned with respect to track 86 similarly to the construction and positioning of followers 88 and 90 with respect to track 84.

In order for the tracks 84 and 86 to cooperate optimally with the corresponding cam followers, the wobble plates 80 and 82 should be formed so that their projection on a plane perpendicular to the axis of the shaft 28 is a circle of a radius such that the cam followers ride on the corresponding tracks 84 and 86. The wobble plates 80 and 82 are oriented with respect to one another so that the compressor and expander pistons 24 and 26 are driven with respect to one another at a phase angle of between about 85° to 103° and preferably of about 90°.

Although the cam grooves 52 and 54 and the wobble plates 80 and 82 have been illustrated as defining regular, single-period curves for driving the pistons 24 and 26 through a single sine wave period for each full rotation of the cylinder 50, it should be apparent that it is also possible to contour the tracks and grooves to define multiple periods or to drive the pistons 24 and 26 in manners that are not sinusoidal. Thus, for instance, the upper or lower extremes of the tracks or grooves might be flattened or peaked to increase or decrease the dwell time of the corresponding piston at one or the other ends of its stroke.

The above described embodiments of the invention can also be implemented in modified Stirling cycle cryogenic coolers having a plurality of compressor and expander piston pairs. For larger capacity refrigerators it is generally more efficient to group a plurality of smaller compressor and expander piston pairs together to cool the cold head than to use a single pair of large pistons.

Figure 3:
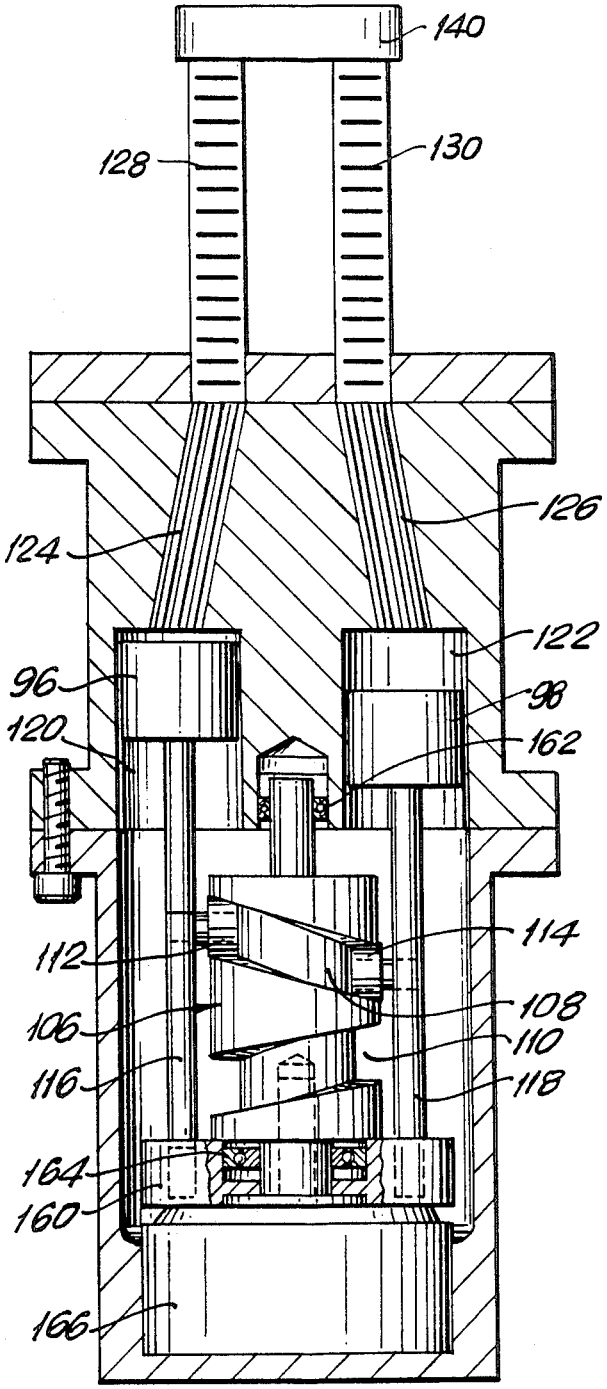
FIG. 3 is a sectional, elevational view of a multi-piston pair modified Stirling cycle cooling unit having a camming drive of the type illustrated in FIG. 1 showing details of the compressor pistons and associated compressor piston drive elements.
Figure 4:
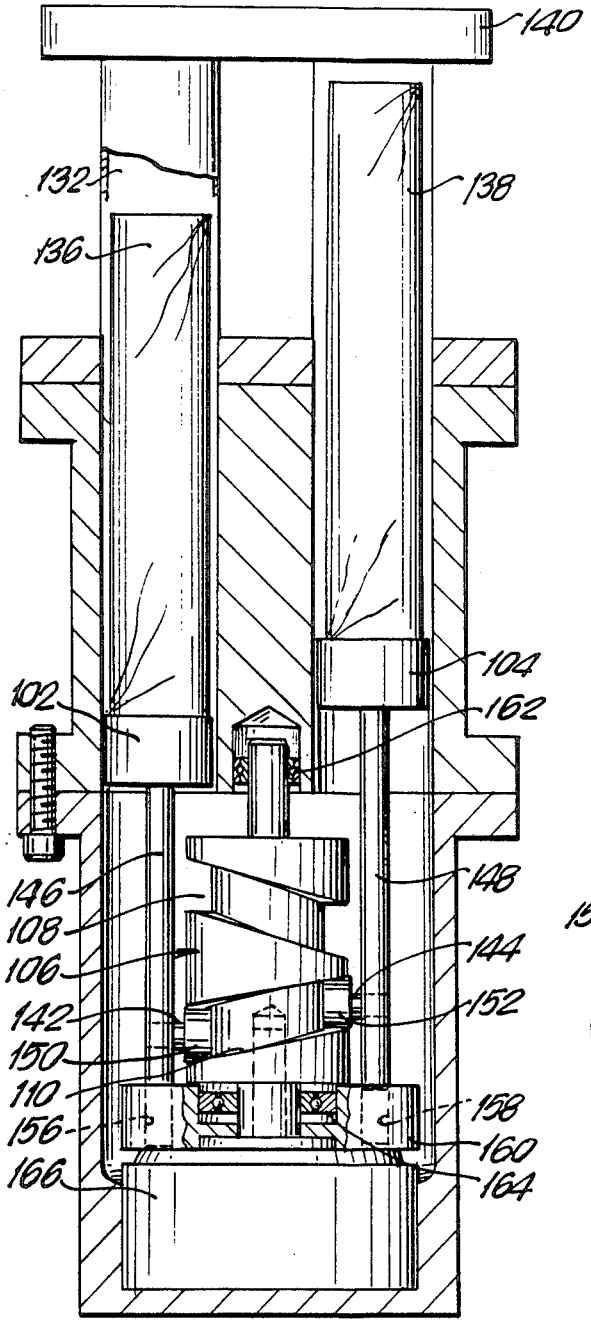
FIG. 4 is a sectional, elevational view of the modified Stirling cycle cooling unit of FIG. 3 illustrating the details of the expander pistons and associated drive elements.
Figure 5:
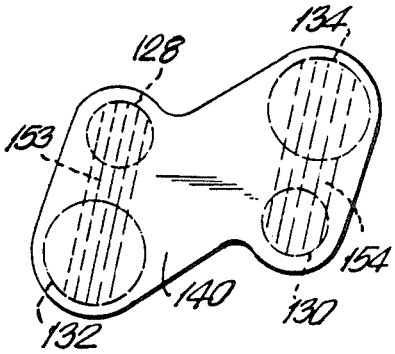
FIG. 5 is a top, elevational view of the cold head of the modified Stirling cycle cooling unit of FIGS. 2–4.

For example, a cam drive assembly of the type illustrated in FIG. 1 can be used to drive a four piston cooling unit, as shown in FIGS. 3–5 in which certain elements, such as the thin walled stainless steel tubes forming the walls of the regenerators and expander cylinders, are shown schematically. In a four piston system, the pistons are grouped into two separate, adjacent compressor-expander piston pairs. The pistons are arranged equidistantly around the cam drive assembly 30 with the pistons being separated from one another by 90° rather than 180° as in a single piston pair embodiment.

FIGS. 3 and 4 are sectional views taken at right angles to one another which depict the two compressor pistons 96 and 98 and the two expander pistons 102 and 104 of the two compressor-expander piston pairs, respectively. For clarity of illustration, only the compressor pistons are shown in FIG. 3 and the expander pistons in FIG. 4.

Each of the piston pairs is driven in the manner described above for the single piston pair refrigerator depicted in FIG. 1. In particular, the cylinder 106 includes first and second cam grooves 108 and 110 for driving the compressor pistons 96 and 98 and expander pistons 102 and 104, respectively. The upper and lower camming surfaces of the cam grooves 108 and 110 are at all points oriented radially normally to the axis of the cylinder 106. Since the compressor and expander pistons of a pair are separated from one another by 90° rather than by 180° as they are in the embodiment of FIG. 1, the cam grooves 108 and 110 are oriented with respect to one another such that one quarter of the circumferential distance around the cylinder 106 corresponds to a leading phase angle between the expander piston and the compressor piston of about 85° to 103° and preferably of about 90°.

The cam followers 112 and 114, connected to the compressor pistons 96 and 98 through the piston rods 116 and 118, respectively, travel in the groove 110 for driving the pistons 96 and 98 in an approximately sinusoidal manner. In the illustrated embodiment, each of the cam followers consists of a roller rotatably mounted on a pin at one end thereof, the other end of which is secured to the corresponding piston rod in a conventional manner.

The compressor pistons 96 and 98 isothermally compress the working gas in the cylinders 120 and 122, respectively. The heat of compression is dissipated by the heat exchangers 124 and 126. The compressed working gas is transferred at constant volume through the heat exchangers 124 and 126 and the regenerators 128 and 130 to the corresponding expander cylinders 132 and 134, where it is expanded by the expander pistons 102 and 104, respectively. The expander pistons 102 and 104 have extenders 136 and 138 formed of an insulating material such as wood affixed to the surface thereof facing the cold head 140 to insulate the expander pistons from the extremely cold temperatures in the vicinity of the cold head 140. The expansion of the working gas in the expander cylinders !32 and 134 extracts heat from the cold head 140, thereby lowering its temperature.

The expander pistons 102 and 104 are coupled to the cam followers 142 and 144 through the piston rods 146 and 148, respectively. The cam followers 142 and 144 consist of pins attached to the corresponding piston rods 146 and 148 and roller bearings 150 and 152 attached to the end of the pins remote from the piston rods. The roller bearings 150 and 152 ride in and are driven by the cam groove 110 in the cylinder 106. The diameter of the roller bearings is slightly less than the width of the cam groove 110.

The rotation of the cylinder 106 causes the cam groove 110 to drive the pistons 102 and 104 in a reciprocal, substantially sinusoidal path in the cylinders 132 and 134 in a leading phase angle of approximately 90° with respect to the corresponding compressor pistons 96 and 98, respectively.

Figure 6:
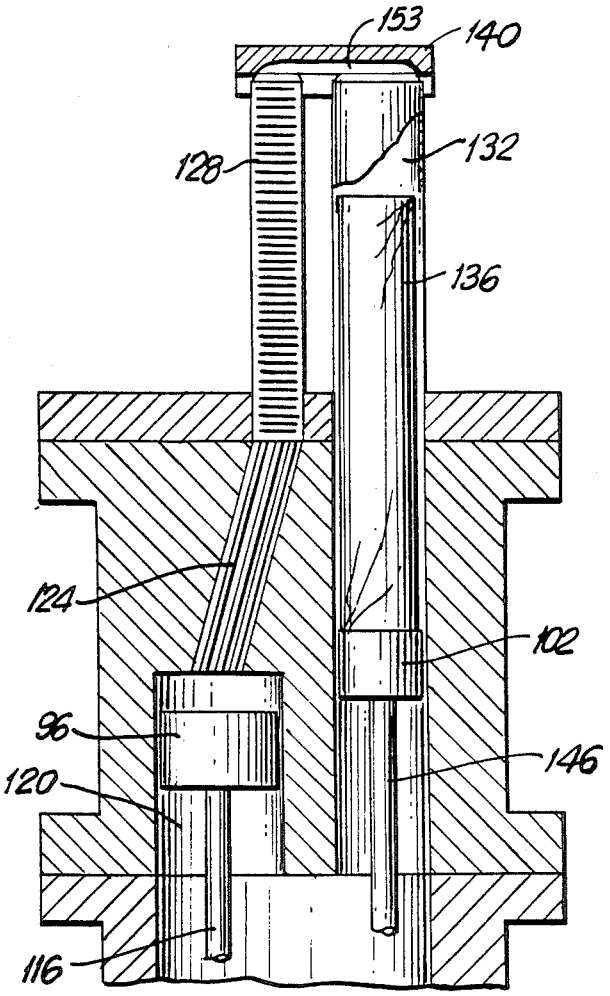
FIG. 6 is a sectional, side elevational view of the modified Stirling cycle cooling unit depicted in FIGS. 2 and 3.

Referring now to FIGS. 5 and 6 of the drawings, the expander cylinders 132 and 134 are connected to the corresponding regenerators 128 and 130 through the channels 152 and 154 formed in the underside of the cold head 140. The surface of the channels 152 and 154 formed by the cold head 140 may be ridged to increase the surface area in contact with the working gas.

The lower end of piston rods 146 and 148 are retained within correspondingly-shaped holes 156 and 158, respectively, formed in the guide member 160. The cylinder 106 is rotatably supported and positioned by the bearings 162 and 164. The cylinder 106 is driven by the electrical motor 166. The cam grooves 108 and 110 are oriented with respect to each other such that the expander pistons 102 and 104 by a phase angle of between 85° to 102° and preferably of about 90°.

It is apparent that the cam drive cylinder 106 illustrated in FIGS. 3 and 4 can be replaced by a wobble plate drive such as one of the type illustrated in FIG. 2 of the drawings. The wobble plate drive would operate in the same manner as was described above with relation to FIG. 2 and the compressor-expander cylinders could be grouped around the wobble plates in the same manner as is described above with relation to the cam drive of FIGS. 3 and 4.

It should also be apparent that additional compressor-expander piston pairs could be grouped around the cam or wobble plate drives of the cryogenic refrigerator of the invention. In such event the contours of the cam grooves or wobble plate tracks must be arranged to maintain the proper phase angle relationship between the compressor and expander pistons of each pair. If, for instance, three piston pairs were grouped around a drive, each cam follower would be separated from the adjacent ones by 60°.

While preferred embodiments of the present invention have been describe in detail above, it will be appreciated that various modifications can be made to the drive mechanisms of the invention without departing from the scope and spirit thereof as specified in the appended claims. For instance the camming grooves and wobble plates might have more complex contours than in the illustrated embodiments for purposes such as increasing or decreasing the dwell time of the piston at a portion of its cycle in a given application. In addition, in certain applications it may be desirable to operate the refrigerator as a motor by running the pistons in the opposite direction.

What is claimed is:

1. A modified Stirling cycle refrigerator having a first piston for compressing a working gas in a first cylinder, a second piston for expanding the working gas in a second cylinder, a channel connecting the cylinders, and a cold head in thermal contact with the working gas in the second cylinder, comprising first and second camming elements mounted for rotation at a phase angle with respect to one another;

a first cam follower mounted in contact with said first camming element and coupled to said first piston for reciprocally driving said first piston in said first cylinder in response to rotation of said first camming element;

a second cam follower mounted in contact with said second camming element and coupled to said second piston for reciprocally driving said second piston in said second cylinder at a predetermined phase angle with said first piston in response to rotation of said second camming element; and motive means for rotating said first and second camming elements.

2. The modified Stirling cycle refrigerator of claim 1 wherein said first and second camming elements are mounted coaxially for rotation about said axis and each includes a camming surface at a predetermined radius from said axis.

3. The modified Stirling cycle refrigerator of claim 2 wherein the radius of the camming surface of the first camming element is equal to the radius of the camming surface of the second camming element.

4. The modified Stirling cycle refrigerator of claim 2 further including a cylindrical element mounted for rotation about said axis, said first and second camming elements each including a continuous circumferential groove in the periphery of said cylindrical element, the sides of each said groove defining upper and lower camming surfaces.

5. The modified Stirling cycle refrigerator of claim 4 wherein each of said grooves defines a generally sinusoidal path around said cylindrical element, the rake of said path being equal to the amplitude of the reciprocation of the piston coupled thereto.

6. The modified Stirling cycle refrigerator of claim 5 further including first and second piston rods attached to said first and second pistons respectively, and wherein said first and second cam followers each include rotatable bearing means riding in the corresponding groove, and shaft means coupling said bearing to the corresponding piston rod.

7. The modified Stirling cycle refrigerator of claim 6 wherein the dimension of said bearing means in the direction of said axis in slightly smaller than the width of the corresponding groove for permitting free rotation of said bearing means in said groove.

8. The modified Stirling cycle refrigerator of claim 2 wherein said first and second camming elements each include a wobble plate mounted for rotation about said axis at a predetermined angle with said axis.

9. The modified Stirling cycle refrigerator of claim 8 in which each of said wobble plates includes upper and lower camming surfaces adjacent the periphery thereof.

10. The modified Stirling cycle refrigerator of claim 9 further including first and second piston rods attached to said first and second pistons respectively, and wherein said first and second cam followers each include bearing means for engaging the upper and lower camming surfaces of the corresponding wobble plate, and means coupling said bearing means to the piston rod attached to the corresponding piston for reciprocally driving said piston.

11. The modified Stirling cycle refrigerator of claim 2 further including third and fourth cylinders, a third piston for compressing a working gas in said third cylinder, a fourth piston for expanding such working gas in said fourth cylinder, a channel connecting said third and fourth cylinders, said working gas being in thermal contact with said cold head when in said fourth cylinder, third and fourth cam followers mounted in contact with said first and second camming elements, respectively, for being reciprocally driven thereby, means coupling said third and fourth pistons to said third and fourth cam followers for being reciprocally driven thereby, said third and fourth cam followers being separated by the same angular distance around said axis as said first and second cam followers.

12. The modified Stirling cycle refrigerator of claim 11 further including a cylindrical element mounted for rotation around said axis, a pair of single-period, substantially sinusoidal, circumferential, axially-spaced grooves in said cylindrical element, said grooves having side walls perpendicular to said axis.

13. The modified Stirling cycle refrigerator of claim 12 wherein said camming elements each include the side walls of one of said grooves.

14. The modified Stirling cycle refrigerator of claim 13 wherein said grooves are oriented at a predetermined phase angle with respect to one another.

15. The modified Stirling cycle refrigerator of claim 11 wherein said first and second camming elements further include first and second wobble plates, respectively, mounted for rotation about said axis in axially-spaced relationship, said wobble plates each including camming tracks proximate the periphery thereof, said cam followers each including roller means engaging the corresponding wobble plate at said camming tracks.

16. The modified Stirling cycle refrigerator of claim 1 wherein said pre-determined phase angle is a leading phase angle of between 85° and 103°.

17. The modified Stirling cycle refrigerator of claim 16 wherein said pre-determined phase angle is a leading phase angle of about 90°.

18. The modified Stirling cycle refrigerator having a plurality of compressor pistons for compressing a working gas in a corresponding plurality of compressor pistons, a plurality of expander pistons for expanding the working gas in a corresponding plurality of expander cylinders, said compressor and expander cylinders being arranged in a plurality of compressor-expander piston pairs, channel means separately coupling the compressor and expander cylinders of each of said pairs for conducting the working gas therebetween, and a cold head in thermal contact with the working gas in said expander cylinders, comprising;

first and second camming elements mounted for rotation about an axis;

means coupling said compressor pistons to said first camming element for a reciprocally driving said compressor pistons in said compressor cylinders upon rotation of said first camming element;

means coupling said expander pistons to said second camming element for reciprocally driving said expander pistons in said expander cylinders upon rotation of said second camming element at predetermined phase angles with respect to the corresponding compressor piston of each compressor-expander piston pair; and motive means for rotating said first and second camming elements about said access.

19. The modified Stirling cycle refrigerator of claim 18 wherein said phase angles are between 85° and 103°.

20. The modified Stirling cycle refrigerator of claim 19 wherein said angles are about 90°.

* * * * *